United States Patent [19]

King, III

[11] Patent Number: 4,611,732

[45] Date of Patent: Sep. 16, 1986

[54] APPARATUS FOR DISPENSING LIQUID

[75] Inventor: Charles C. King, III, Germantown, Tenn.

[73] Assignee: K-Sun Company, Inc., Memphis, Tenn.

[21] Appl. No.: 684,112

[22] Filed: Dec. 20, 1984

[51] Int. Cl.[4] ..... B67D 5/34; B67D 5/08

[52] U.S. Cl. ..... 222/639; 222/2; 222/397; 222/399; 222/442; 222/450

[58] Field of Search ..... 222/639, 61, 442, 399, 222/450, 2, 394, 397

[56] References Cited

U.S. PATENT DOCUMENTS

| | | | |
|---|---|---|---|
| 1,639,679 | 8/1927 | Zsoldos | 222/639 |
| 2,520,398 | 8/1950 | Hanks | 222/397 |
| 2,645,383 | 7/1953 | Miller | 222/450 |
| 2,889,892 | 6/1959 | Schaub et al. | 222/450 |
| 2,971,647 | 2/1961 | Petrusek | 222/639 |
| 3,019,764 | 2/1962 | Schilling | 222/450 |
| 3,380,628 | 4/1968 | Cox, Jr. | 222/442 |
| 3,833,149 | 9/1974 | Iozzio | 222/639 |
| 4,171,039 | 10/1979 | Ingham | 194/9 T |

FOREIGN PATENT DOCUMENT 869,251 5/1961 United Kingdom.

*Primary Examiner*—Joseph J. Rolla
*Assistant Examiner*—Edward S. Ammeen
*Attorney, Agent, or Firm*—Nies, Webner, Kurz & Bergert

[57] ABSTRACT

Measured quantities of liquid, such as suntan oil or lotion, are dispensed to a user upon insertion of one or more coins into a coin-controlled timer. The coin-controlled timer, such as a timer-relay, applies electrical current to control a valve-controlled air supply to an atomizing nozzle. The timer system further controls the liquid supply by utilizing the air supply to actuate air valves.

1 Claim, 2 Drawing Figures

APPARATUS FOR DISPENSING LIQUID

BACKGROUND OF THE INVENTION

This invention relates to coin-operated liquid dispensing apparatus for delivering discrete quantities of liquid, such as suntan oil or lotion, to individual users, through an atomizing nozzle.

Prior art apparatus, such as those of Ingham, U.S. Pat. No. 4,171,039, Iozzio, U.S. Pat. No. 3,833,149, and Zsoldos, U.S. Pat. No. 1,639,679, use time-controlled dispensing systems which have no mechanism for dispensing a discrete, measured amount of the liquid.

It is an object of the present invention to provide a simple apparatus for dispensing liquids, such as suntan oil or lotion, in which a discrete, measured quantity of liquid is dispensed to the user by means of a coin-controlled timing mechanism, the discrete quantity of liquid being measured by means of air operated control valves and adjustable needle values.

DESCRIPTION OF THE INVENTION

The invention will best be understood by reference to the drawings in which.

Figure 1:
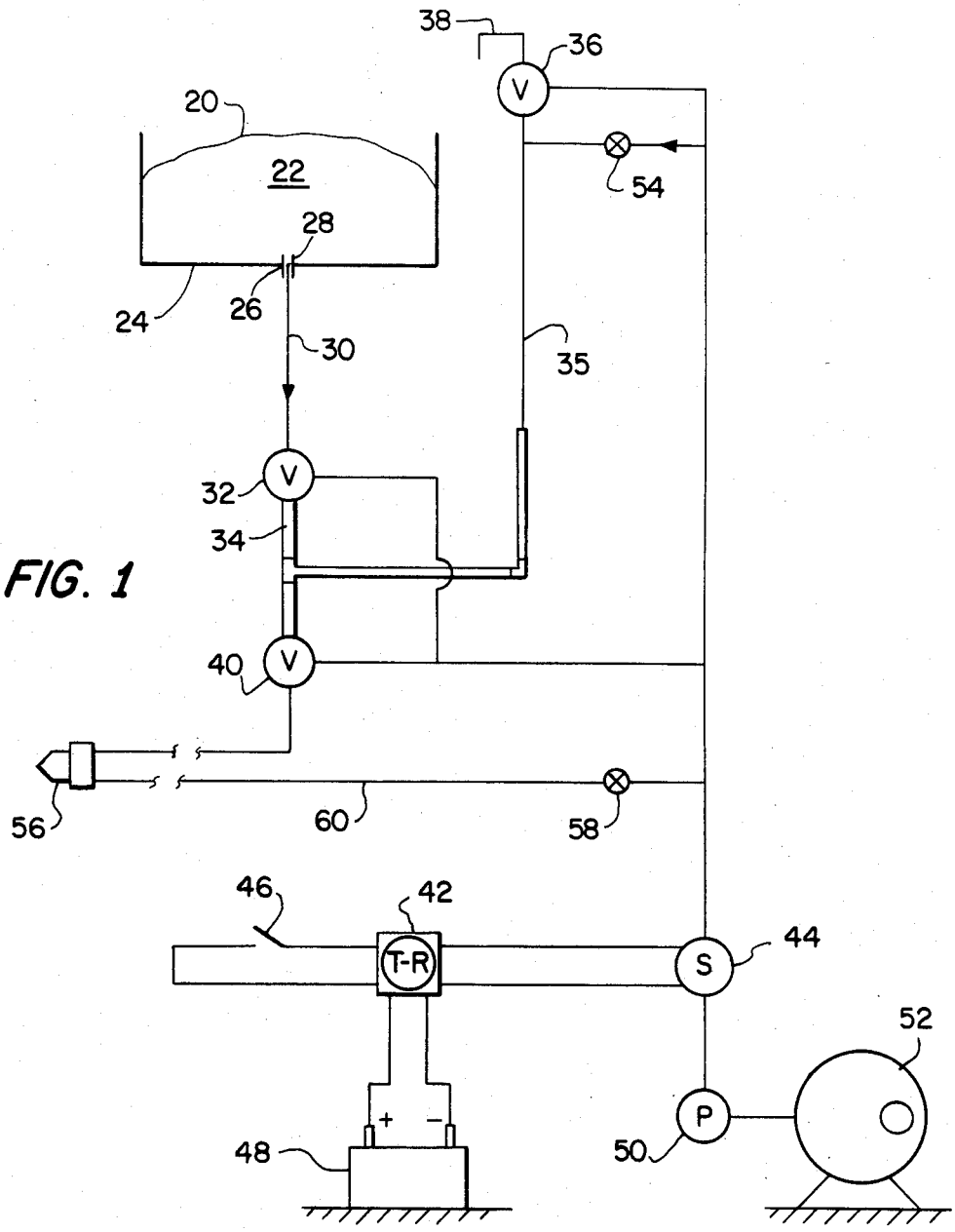
FIG. 1 shows a schematic representation of the apparatus.

The apparatus shown in FIG. 1 comprises a collapsible reservoir 20, for example, a 5-gallon bag, filled with liquid 22, such as suntan oil or lotion, encased in a box 24 of suitable dimensions. The box 24 has an aperture 26 in its base through which tube 28 protrudes. Tube 28 is sealingly clamped into bag 20 at one end and at the other end is fastened over pipe 30 leading from box 24 to normally open air-actuated control valve 32. valve 32 being normally open, permits liquid 22 to flow into trap chamber 34, which may comprise a ¼ inch PVC pipe. From trap chamber 34 a line 35, suitably of ¼ inch nylon tubing is run vertically up through another air-actuatable normally open control valve 36 to vent 38 which vents to the atmosphere. Control valve 36 is located at a level higher than the level of liquid 22 in bag 20, so that, when the system is not being operated, liquid 22 fills pipe 30, control valve 32, trap chamber 34, and line 35 to find its own level in line 35 at the same height as the level of liquid 22 in bag 20, by gravity. A third control valve 40, which is normally closed, does not permit liquid to flow out of the system until the system has been activated.

The air system is controlled by a timer, for example, timer-relay 42 attached to solenoid valve 44 which is actuated by coin-actuated switch 46. Upon insertion of one or more coins or tokens, switch 46 is closed, timer-relay 42 starts running for a preset period, generally of 0.6 to 60 seconds. Timer-relay 42 is powered by, for example, alternating current, or by a battery 48. Battery 48 energizes solenoid valve 44 while timer-relay 42 is running, and permits the air system to be pressurized through pressure regulator 50 which is connected to air supply tank 52. Air supply tank 52 may be a high pressure air bottle or cylinder or may be a lower pressure air reservoir fed by a compressor. Upon actuating switch 46, timer-relay 42 starts running, solenoid valve 44 opens, and the air system is pressurized by means of pressure regulator 50 and air supply tank 52. Actuation of switch 46 simultaneously causes the normally open control valves 32 and 36 to close and the normally closed control valve 40 to open. The liquid in line 35 is thus closed to the atmosphere by the closing of valve 36, and the liquid is forced through line 35 by air pressure fed through needle valve 54 to the top of line 35. Trap chamber 34 is opened through valve 40, now open, to the atomizing nozzle 56, and the pressure differential forces the liquid from the trap chamber to nozzle 56. Simultaneously, a stream of air is directed to atomizing nozzle 56 through needle valve 58 and line 60. Thus the air supply and liquid supply simultaneously enter the atomizing nozzle and are mixed, and a fine spray of air atomized liquid, such as a spray of suntan oil or lotion, is delivered to the user. This delivery of liquid spray continues until either the liquid in the reservoir has been consumed or the set time period has elapsed causing the air system to cease pressurizing the system and causing valves 32 and 36 to reopen and valve 40 to close. Needle valves 54 and 58 should be adjusted so that the oil delivered during one cycle is equal to that desired for the pre-set time interval. In operation, the coin actuated switch starts the timer-relay which starts the solenoid valve and the timer-relay energizes the solenoid for a pre-set time.

The system resets itself at the end of the cycle. The solenoid valve 44 closes, the air pressure returns to normal, valves 32 and 36 reopen and valve 40 closes, allowing line 35 to fill with liquid, the trap chamber 34 refills with liquid, and the timer-relay 42 resets ready for the next coin or token operated cycle.

Figure 2:
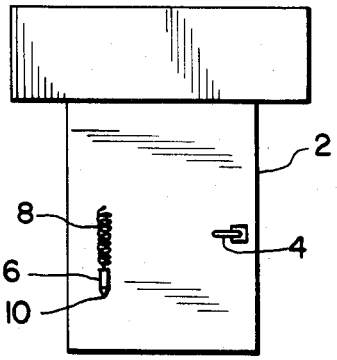
FIG. 2 shows a front view of one embodiment of the invention.

Referring now to FIG. 2, the liquid dispensing unit 2 has coin slot 4 and handpiece 6 secured to its face. Handpiece 6 is secured to the unit by conduit means 8 and has an atomizing nozzle 10 at its free end for delivery of liquid to the user following deposit of one or more coins or tokens into slot 4.

In a non-limiting example, the system operates so that ½ ounce of suntan oil is dispensed in each 20 second cycle. Each such 20 second cycle requires approximately 1/7 cu. ft. air at standard temperature and pressure.

The control valves are described here as air-controlled valves. While there are advantages to having air-controlled valves, these valves may be solenoid valves or other electrically controlled valves.

Although the invention has been described in considerable detail with reference to certain preferred embodiments thereof, it will be understood that variations and modifications can be effected within the spirit and scope of the invention as described above and as defined in the appended claims.

We claim:

1. A dispensing system comprising:

a reservoir adapted to contain liquid to be dispensed, an atomizing dispensing nozzle, a trap chamber below the reservoir in conduit means connecting the reservoir and the dispensing nozzle, a normally open first valve means in the conduit between the trap chamber and the reservoir, a normally closed second valve means in the conduit between the trap chamber and the nozzle, a vent leading from the trap chamber to the atmosphere, a normally open third valve means in the vent, supply means for compressed air, piping leading from the compressed air supply means to said nozzle and to said trap chamber, a normally closed control valve in the piping between said air supply means and the trap chamber and said nozzle, and means for simultaneously closing the first and third valve means while opening the second valve means whereby air under pressure forces liquid from the trap chamber through the nozzle and atomizes the liquid issuing from the nozzle, the means for simultaneously closing the first and third valve means while opening the second valve means being characterized in that each of said valve means is compressed air actuated, and said piping also including branches leading from downstream of said control valve to said first, second and third valve means wherein the air that atomizes the liquid issuing from the nozzle is fed through a line from the air supply means to the nozzle at the same time as the liquid in the trap chamber is being fed to the nozzle by the force of pressurized air from the air supply means.

* * * * *